United States Patent [19]

MacDonald

[11] 4,143,767

[45] Mar. 13, 1979

[54] TIRE PATCHING KIT

[76] Inventor: Kelvyn I. MacDonald, 2248 Wenonah St., Vancouver, B. C., Canada, V5N 2Z6

[21] Appl. No.: 921,193

[22] Filed: Jul. 3, 1978

[51] Int. Cl.[2] ..... B65D 73/00; B65D 85/00; B60C 21/02

[52] U.S. Cl. ..... 206/582; 152/367; 152/371; 156/97; 206/223

[58] Field of Search ..... 152/367, 371; 206/302, 206/447, 461, 482, 483, 582, 484, 806; 138/97-99; 156/97, 95; 425/11

[56] References Cited

U.S. PATENT DOCUMENTS

| | | | |
|---|---|---|---|
| 2,833,327 | 5/1958 | Boyce | 152/367 |
| 3,133,586 | 5/1964 | Wolfe | 152/367 |
| 3,225,916 | 12/1965 | Field et al. | 206/372 |
| 3,278,015 | 10/1966 | Bernstein | 206/461 |
| 3,913,734 | 10/1975 | Siegel | 206/484 |

*Primary Examiner*—Francis S. Husar
*Assistant Examiner*—Lawrence E. Williams
*Attorney, Agent, or Firm*—Daniel Jay Tick

[57] ABSTRACT

A tire patch is removably affixed to the front surface of a backing sheet in an area defined by a broken line extending intermediate and parallel to the top and bottom edges of the sheet and the bottom edge thereof. A sheet of abrasive material is removably affixed to the tire patch. A sealed container of liquid cement for affixing a tire patch to a tire is affixed to the front surface of the sheet in the area defined by the broken line and the top edge of the sheet and has a narrow neck just crossing the broken line whereby when the backing sheet is cut along the broken line the neck is opened and the cement is available for use.

1 Claim, 3 Drawing Figures

TIRE PATCHING KIT

BACKGROUND OF THE INVENTION

The present invention relates to a tire patching kit.

Tire patching kits are disclosed in U.S. Pat. Nos. 1,650,420; 1,716,648; 1,996,285; 2,248,318; 2,596,179; 2,821,298; 2,852,058; 3,039,509; 3,133,586; 3,260,296; 3,282,319 and 3,730,247.

Objects of the invention are to provide a tire patching kit of simple structure, which is inexpensive in manufacture, provides basic materials for patching a tire of any type such as, for example, a bicycle tire, the tire of an automotive vehicle, a motorcycle tire, any inflatable rubber envelope such as, for example, a life raft, a water bed, or the like, with great facility and convenience, stores the basic ingredients in an extremely handy and convenient manner, and functions efficiently, effectively and reliably to provide just the necessary ingredients or materials for patching a tire or envelope without waste of any kind.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 3:
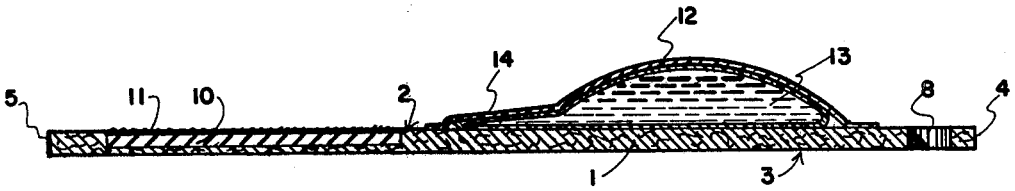
FIG. 3 is a cross-sectional view, on an enlarged scale, taken along the lines III—III, of FIG. 2.

The tire patching kit of the invention comprises a backing sheet 1 of any suitable material such as, for example, paper, cardboard, or the like, of substantially rectangular configuration having front and back surfaces 2 and 3, respectively (FIG. 3). The backing sheet 1 has a top edge 4, a spaced parallel bottom edge 5, and a pair of spaced parallel side edges 6 and 7 joining the top and bottom edges and perpendicular thereto.

The backing sheet 1 has a hole 8 formed therethrough in proximity with the top edge 4 thereof and substantially equidistant between the side edges 6 and 7 thereof. A broken line 9 (FIGS. 1 and 2) is marked on the front surface 2 of the sheet 1 and extends intermediate and parallel to the top and bottom edges 4 and 5 of said sheet.

A tire patch 10 (FIGS. 1 and 3) is removably affixed to the front surface 2 of the backing sheet 1 in the area defined by the broken line 9 and the bottom edge 5 of said sheet.

A sheet of abrasive material 11 such as, for example, sandpaper, is removably affixed to the tire patch 10, as shown in the FIGS.

A sealed container 12 of liquid cement 13 (FIG. 3) is affixed to the front surface 2 of the backing sheet 1 in the area defined by the broken 9 and the top edge 4 of said sheet. The container 12 has a narrow neck 14 just crossing the broken line 9, as shown in FIGS. 1 and 2, whereby when the backing sheet is cut along said broken line, the neck is opened and the cement 13 is available for use.

The cement 13 is of any suitable type for affixing the tire patch 10 to a tire.

Figure 1:
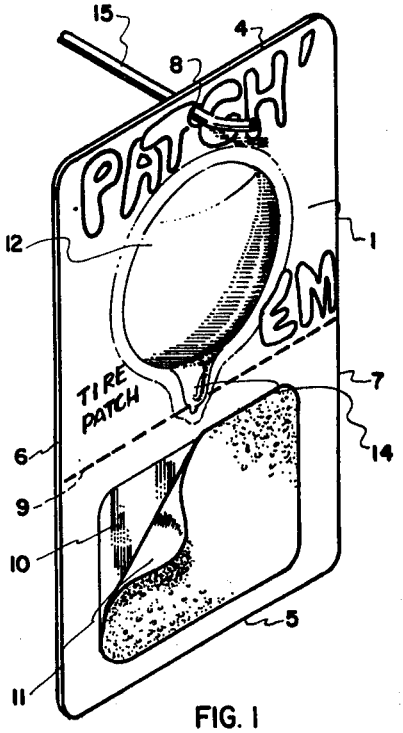
FIG. 1 is a perspective view of an embodiment of the tire patching kit of the invention, hanging on a display pin.
Figure 2:
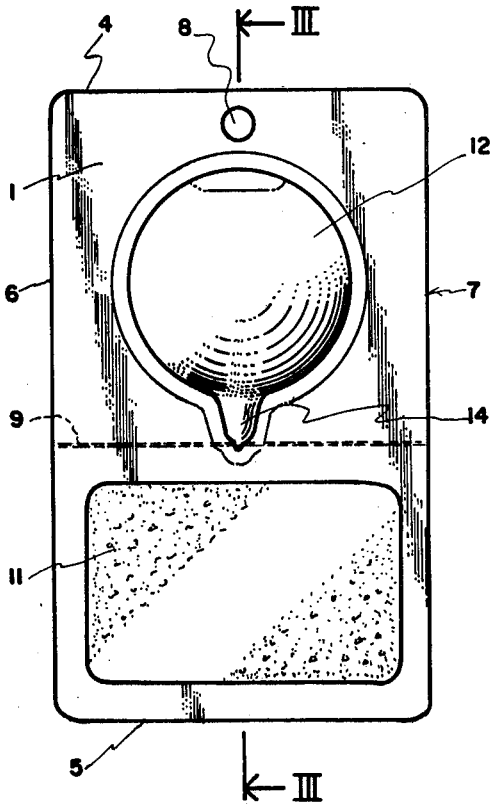
FIG. 2 is a front view of the embodiment of FIG. 1.

The tire patching kit is readily displayed for sale, in the manner shown in FIG. 1, by hanging it on a pin 15 which extends through the hole 8 through the backing sheet 1.

While the invention has been described by means of a specific example and in a specific embodiment, I do not wish to be limited thereto, for obvious modifications will occur to those skilled in the art without departing from the spirit and scope of the invention.

I claim:

1. A tire patching kit, comprising a backing sheet of substantially rectangular configuration having front and back surfaces, a top edge, a spaced parallel bottom edge and a pair of spaced parallel side edges joining the top and bottom edges and perpendicular thereto, said backing sheet having a hole formed therethrough in proximity with the top edge and substantially equidistant between the side edges thereof and a broken line marked on the front surface of the said sheet extending intermediate and parallel to the top and bottom edges of said sheet;

a tire patch removably affixed to the front surface of said sheet in the area defined by the broken line and the bottom edge thereof;

a sheet of abrasive material removably affixed to the tire patch; and a sealed container of liquid cement for affixing the tire patch to a tire, said container being affixed to the front surface of said sheet in the area defined by the broken line and the top edge thereof and having a narrow neck just crossing said broken line whereby when said backing sheet is cut along said broken line the neck is opened and the cement is available for use.

* * * * *